US011276977B2

(12) United States Patent
Cen et al.

(10) Patent No.: US 11,276,977 B2
(45) Date of Patent: Mar. 15, 2022

(54) ELECTRICAL CONNECTOR AND METHOD OF ASSEMBLING THE SAME

(71) Applicant: Amphenol FCI Connectors Singapore Pte. Ltd., Singapore (SG)

(72) Inventors: Liaoju Cen, Dongguan (CN); Jun Chen, Dongguan (CN); Lu Song, Dongguan (CN)

(73) Assignee: Amphenol FCI Connectors Singapore Pte. Ltd., Singapore (SG)

( * ) Notice: Subject to any disclaimer, the term of this patent is extended or adjusted under 35 U.S.C. 154(b) by 126 days.

(21) Appl. No.: 16/336,355

(22) PCT Filed: Oct. 3, 2017

(86) PCT No.: PCT/SG2017/050496
§ 371 (c)(1),
(2) Date: Mar. 25, 2019

(87) PCT Pub. No.: WO2018/067069
PCT Pub. Date: Apr. 12, 2018

(65) Prior Publication Data

US 2019/0229484 A1 Jul. 25, 2019

(30) Foreign Application Priority Data

Oct. 4, 2016 (SG) ..... 10201608298S

(51) Int. Cl.
*H01R 43/00* (2006.01)
*H01R 43/20* (2006.01)
(Continued)

(52) U.S. Cl.
CPC ..... *H01R 43/205* (2013.01); *H01R 12/722* (2013.01); *H01R 13/516* (2013.01);
(Continued)

(58) Field of Classification Search
CPC .... H01R 43/205; H01R 12/722; H01R 12/70; H01R 12/7047; H01R 12/7058; H01R 13/516
(Continued)

(56) References Cited

U.S. PATENT DOCUMENTS 6,102,734 A 8/2000 Kuo
6,293,825 B1 9/2001 Huang
(Continued)

FOREIGN PATENT DOCUMENTS

CN 102074844 A 5/2011
CN 102456974 A 5/2012
(Continued)

OTHER PUBLICATIONS

PCT/SG2017/050496, Nov. 7, 2018, International Search Report and Written Opinion.
(Continued)

*Primary Examiner* — Peter Dungba Vo
*Assistant Examiner* — Azm A Parvez
(74) *Attorney, Agent, or Firm* — Wolf, Greenfield & Sacks, P.C.

(57) ABSTRACT

An electrical connector comprises a housing and a terminal module. The housing has a top portion, a bottom portion and two side portions connecting the top portion and the bottom portion. The top portion, the bottom portion and the two side portions form an accommodating chamber and the terminal module is accommodated in the accommodating chamber. The two side portions have positioning posts preventing horizontal displacement of the housing relative to the terminal module, and the top portion and the bottom portion prevent vertical displacement of the housing relative to the terminal module. Methods of assembling the electrical connector are also provided.

19 Claims, 8 Drawing Sheets

(51) Int. Cl.
*H01R 12/72* (2011.01)
*H01R 13/516* (2006.01)
*H01R 12/70* (2011.01)

(52) U.S. Cl.
CPC ..... *H01R 12/70* (2013.01); *H01R 12/7047* (2013.01); *H01R 12/7058* (2013.01)

(58) Field of Classification Search
USPC ..... 29/842, 829, 825, 592.1
See application file for complete search history.

(56) References Cited

U.S. PATENT DOCUMENTS

| | | | | |
|---|---|---|---|---|
| 8,403,705 | B2 * | 3/2013 | Liu | H01R 24/64 439/607.4 |
| 8,888,534 | B2 | 11/2014 | Toda | |
| 2013/0273768 | A1 | 10/2013 | Peng | |
| 2014/0134885 | A1 | 5/2014 | Yu et al. | |
| 2015/0180171 | A1 | 6/2015 | Okabe | |

FOREIGN PATENT DOCUMENTS

| | | | |
|---|---|---|---|
| CN | 103178383 | A | 6/2013 |
| CN | 103811917 | A | 5/2014 |
| CN | 105792574 | A | 7/2016 |
| JP | 2014-241199 | A | 12/2014 |

OTHER PUBLICATIONS

PCT/SG2017/050496, Apr. 18, 2019, International Preliminary Report on Patentability.
International Search Report and Written Opinion for International Application No. PCT/SG2017/050496 dated Nov. 7, 2018.
International Preliminary Report on Patentability for International Application No. PCT/SG2017/050496 dated Apr. 18, 2019.
Chinese Office Action in connection with Chinese Application No. 201780060012.5 dated Apr. 1, 2020.
CN 201780060012.5, Apr. 1, 2020, Chinese Office Action.
Chinese Office Action dated Mar. 12, 2021 in connection with Chinese Application No. 201780060012.5.

* cited by examiner

ELECTRICAL CONNECTOR AND METHOD OF ASSEMBLING THE SAME

CROSS-REFERENCE TO RELATED APPLICATIONS

This application is a 35 U.S.C. § 371 National Phase filing of International Application No. PCT/SG2017/050496, filed Oct. 3, 2017, entitled "ELECTRICAL CONNECTOR AND METHOD OF ASSEMBLING THE SAME," which claims priority to and the benefit of Singaporean Patent Application No. 10201608298S, filed Oct. 4, 2016. The entire contents of these applications are incorporated herein by reference in their entirety.

FIELD OF THE INVENTION

The present invention relates to an electrical connector, and particularly relates to a circuit board connector.

BACKGROUND

Circuit board connectors are widely used in electrical apparatus for establishing electrical connection between circuit boards.

Traditional circuit connectors have the housings integrated with terminal modules thereof. It requires mounting the electrical connector as a whole to a printed circuit board. However, this requirement leads to mounting complexity in some applications. It is therefore desirable to improve the mounting process of circuit board connectors.

SUMMARY

According to a first aspect, an electrical connector comprises a housing and a terminal module assembled to the housing. The housing has a top portion, a bottom portion and two side portions connecting the top portion and the bottom portion, the top portion, the bottom portion and the two side portions form an accommodating chamber and the terminal module is accommodated in the accommodating chamber. The two side portions have positioning posts extending downwardly for positioning and mounting the housing to a circuit board. The top portion and the bottom portion prevent vertical displacement of the housing relative to the terminal module.

In accordance with a second aspect, a method of assembling an electrical connector is provided. The electrical connector comprises a housing and a terminal module and the housing has an entrance and positioning posts. The method comprises fixing the terminal module to a printed circuit board; rotating the housing such that an effective height of the entrance is larger than a height of the terminal module; guiding the terminal module to enter an accommodating chamber of the housing through the entrance; and rotating the housing and inserting the positioning posts into corresponding holes of the printed circuit board.

In accordance with a third aspect, a method of assembling an electrical connector is provided. The electrical connector comprises a housing and a terminal module. The method comprises accommodating the terminal module partially in an accommodating chamber of the housing and angularly displacing the housing to accommodate the terminal module fully in an accommodating chamber of the housing.

BRIEF DESCRIPTION OF THE DRAWINGS

The accompanying figures, where like reference numerals refer to identical or functionally similar elements throughout the separate views and which together with the detailed description below are incorporated in and form part of the specification, serve to illustrate various embodiments and to explain various principles and advantages in accordance with the present invention.

Skilled artisans will appreciate that elements in the figures are illustrated for simplicity and clarity and may necessarily be depicted to scale. For example, the dimensions of some of the elements may be exaggerated in respect to other elements to help improve understanding of the embodiments.

DETAILED DESCRIPTION

The following detailed description is merely exemplary in nature and is not intended to limit the invention or the application and uses of the invention. Furthermore, there is no intention to be bound by any theory presented in the preceding background of the invention or the following detailed description. It is the intent of the present embodiment to provide an advantageous electrical connector that offers easy and reliable assembling as well as low defective rates and low manufacturing costs.

According to one embodiment of the invention, an electrical connector provided comprises a housing and a terminal module configured to be respectively assembled to a printed circuit board. The provided electrical connector decreases assembling complexity and enables separate removal and replacement of the housing, which thus reduces manufacturing costs and maintenance costs of clients products.

Figure 1:
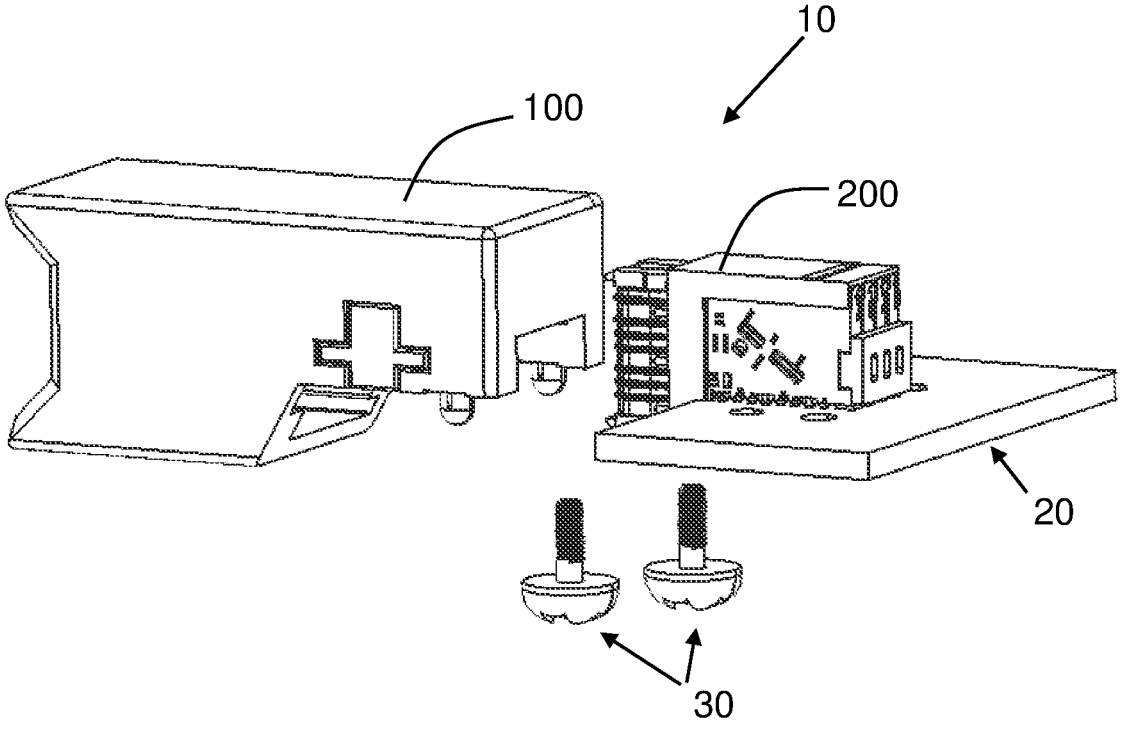
FIG. 1 is an exploded perspective view of an electrical connector in accordance with one embodiment.

FIG. 1 is an exploded perspective view of an electrical connector 10 in accordance with one embodiment of the present invention. The electrical connector 10 comprises a housing 100 and a terminal module 200 that is to be mounted onto a printed circuit board 20 as shown in FIG. 1. In use, the housing 100 is also mounted to the printed circuit board 20, with terminal module 200 positioned in the housing 100, as shown in FIG. 2.

Figure 2:
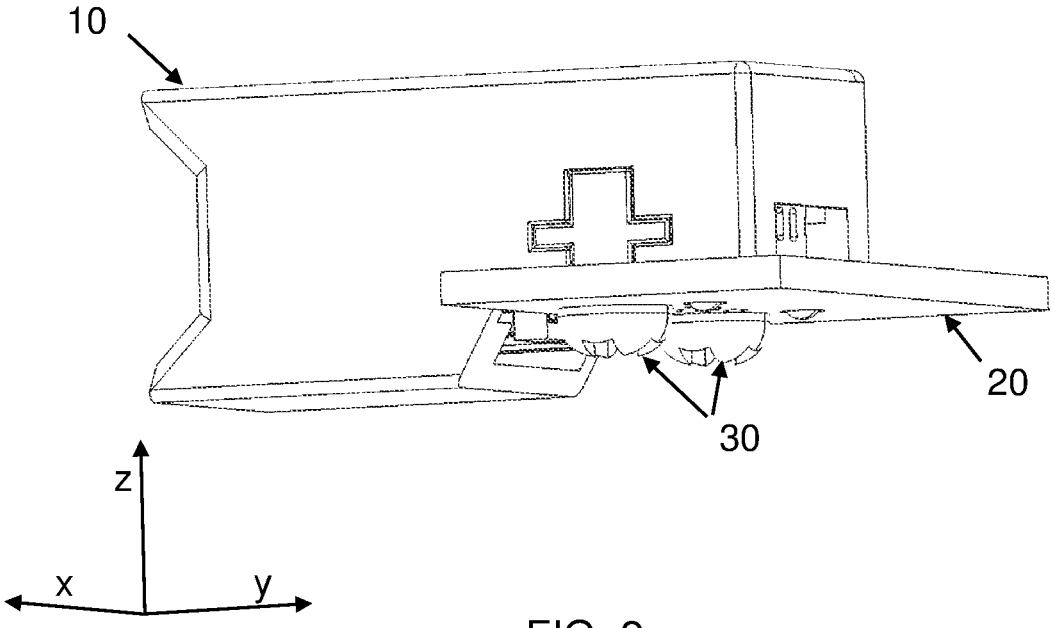
FIG. 2 is a perspective view of the electrical connector of FIG. 1.

To assist clear understanding, an x-y-z axis system is shown in FIG. 2 with x axis parallel to a width direction of the connector 10, y axis parallel to a length direction of the connector 10 and z axis parallel to a height direction of the connector 10. Further, description of 'left' and 'right' in the context is intended to mean direction along the negative x axis and positive x axis, respectively; description of 'top' and 'bottom' is intended to mean direction along the positive z axis and negative z axis, respectively; description of 'front and 'back is intended to mean direction along the negative y axis and positive y axis, respectively.

Figure 3:
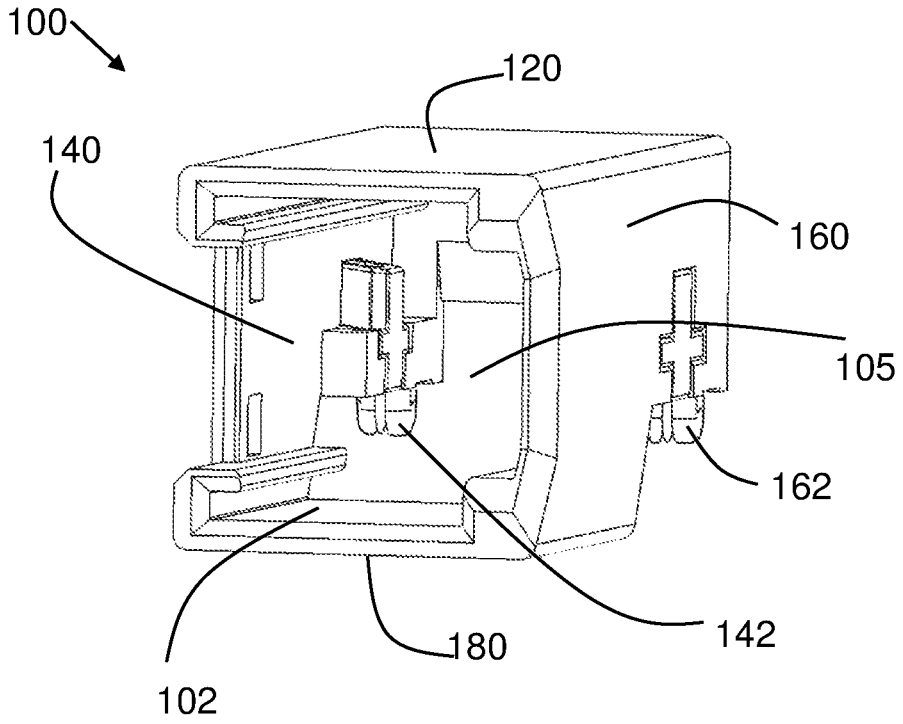
FIG. 3 is a perspective view of a housing of the electrical connector of FIG. 1.
Figure 4:
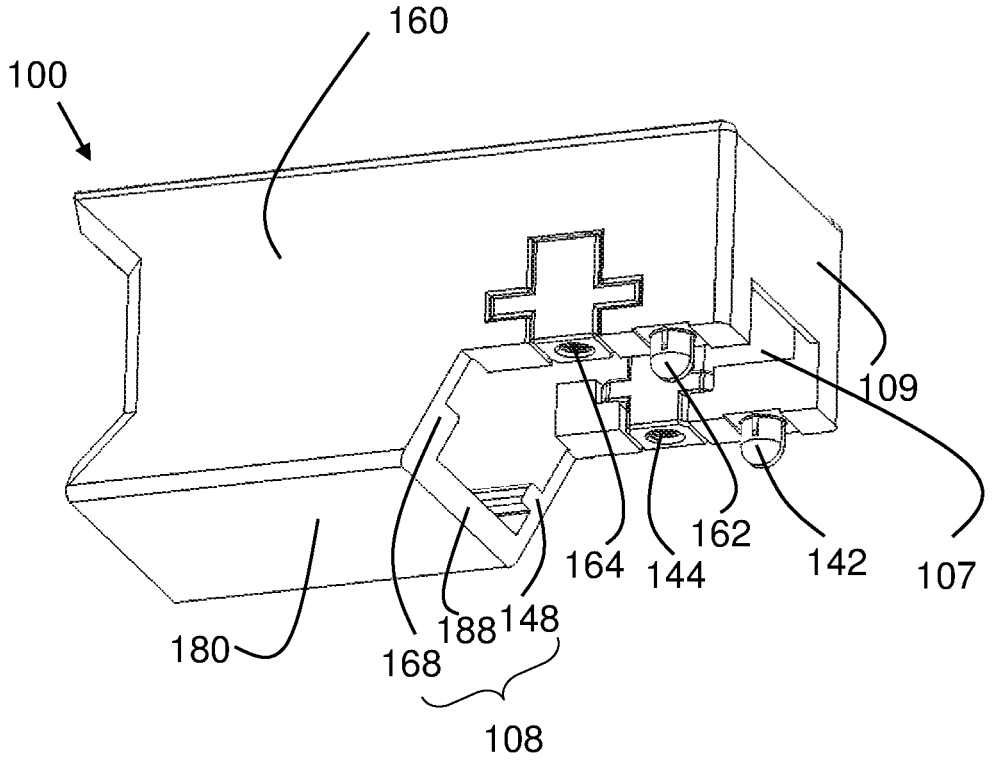
FIG. 4 is a bottom perspective view of a housing of the electrical connector of FIG. 1.
Figure 5:
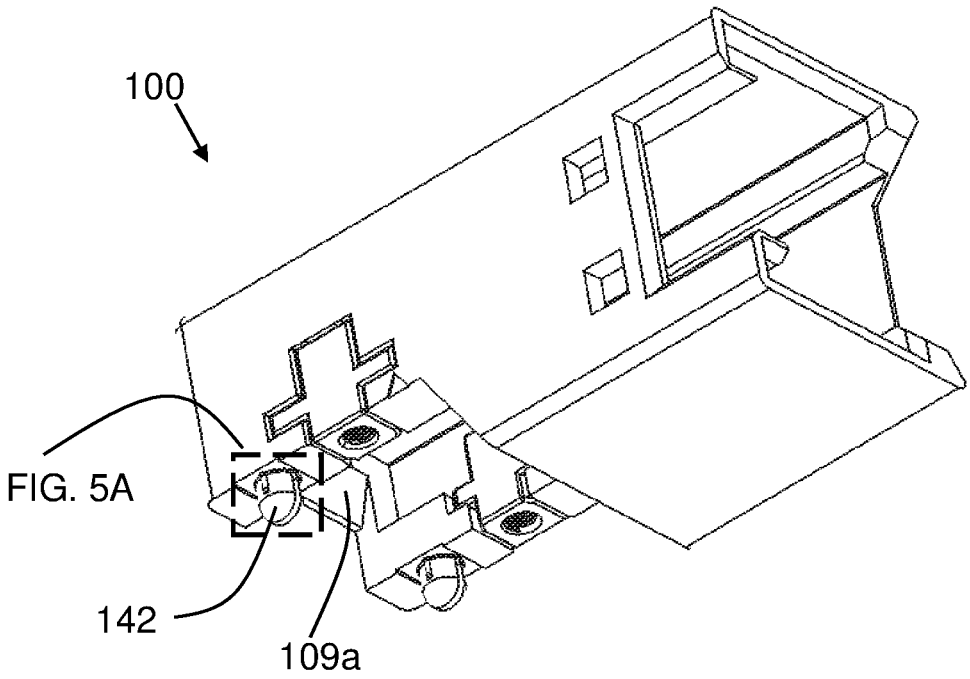
FIG. 5 is a bottom perspective view of a housing of the electrical connector of FIG. 1.

As shown in FIGS. 3 to 5, housing 100 has a top portion 120, a left portion 140, a right portion 160 and a bottom portion 180. The top portion 120 is connected respectively with top edges of the left portion 140 and the right portion 160, and the bottom portion 180 is connected respectively with bottom edges of the left portion 140 and the right portion 160. The top portion 120, the left portion 140, the right portion 160 and the bottom portion 180 form an accommodating chamber 105 having a front entrance 102 for receiving an counterpart connector for mating with the terminal module 200.

The left portion 140 and the right portion 160 may have notches at front ends thereof, respectively, assisting in receiving a counterpart connector to mate with the terminal module 200. The notches may have different shape and configuration, for example, square-shaped or trapezoid-shaped. Front ends of the top portion 120, the left portion 140, the right portion 160 and the bottom portion 180 may have tapered surfaces to guide terminals of a counterpart connector.

The bottom portion 180 of the housing 100 has a length shorter than the top portion 120 in the length direction of the housing 100 (i.e. the direction of y axis). A back edge 188 of the bottom portion 180, a back edge 148 of the left portion 140 and a back edge 168 of the right portion 160 form a chamfer 108.

A top back edge of the left portion 140 is connected with a top back edge of the right portion 160 through a downward-extending back portion 109. The housing 100 with a back portion 109 provides a higher structural strength and rigidity. The back portion 109 may have a notch at a bottom end thereof. The back portion 109 may also have a back chamfer 109*a* at a portion facing the accommodating chamber 105 of the housing 110.

The left portion 140 and the right portion 160 have mounting surfaces between the chamfer 108 and the back portion 109 for engaging with a printed circuit board. The left portion 140 has a left positioning post 142 extending downwardly from the mounting surface thereof and a left mounting hole 144 for receiving a mounting screw. The left mounting hole 144 and the left positioning post 142 are aligned in a line parallel with the length direction of the housing 100. The right portion 160 has a right positioning post 162 extending downwardly from the mounting surface thereof and a right mounting hole 164 for receiving another mounting screw. The right mounting hole 164 and the right positioning post 162 are also aligned in a line parallel with the length direction of the housing 100. The left mounting hole 144 and the right mounting hole 164 may be formed on components separately formed from the housing 100, as shown in FIG. 4, and the components having the left mounting hole 144 and the right mounting hole 164 are embedded in corresponding cross shaped openings in the housing 100.

The chamfer 108, the mounting surfaces of the left portion 140 and the right portion 160 and the back chamfer 109*a* form a back entrance 107 into the chamber 105 of housing 100. During the process of mounting the electrical connector 10 to a printed circuit board, the terminal module 200 is firstly mounted to a printed circuit board, and then received and accommodated in the accommodating chamber 105 of housing 100, through the back entrance 107, and thereafter the housing 100 is mounted on the printed circuit board.

Figure 5A:
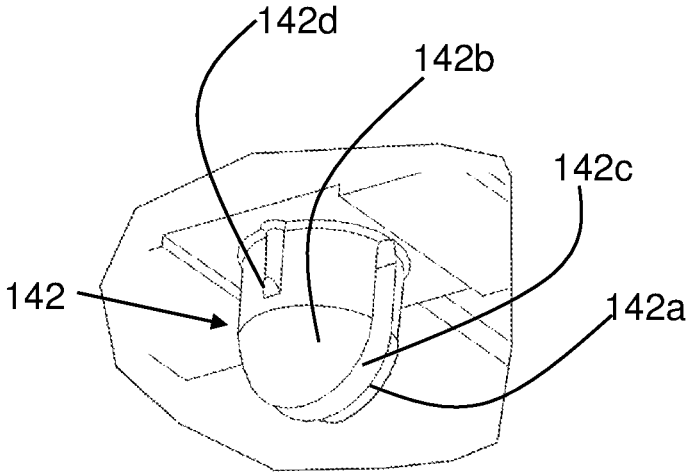
FIG. 5A is a partial enlarged view of FIG. 5.

FIG. 5A is an enlarged perspective view of the positioning post 142. The positioning posts 142 and 162 have similar shape and dimension. Taking the positioning post 142 as an example, it is substantially cylindrical shaped having a spherical top end and two symmetrical halves 142*a* and 142*b* separated by a gap 142*c*. The two halves 142*a* and 142*b* each has a resilient piece 142*d* protruded from a side surface thereof.

Figure 6:
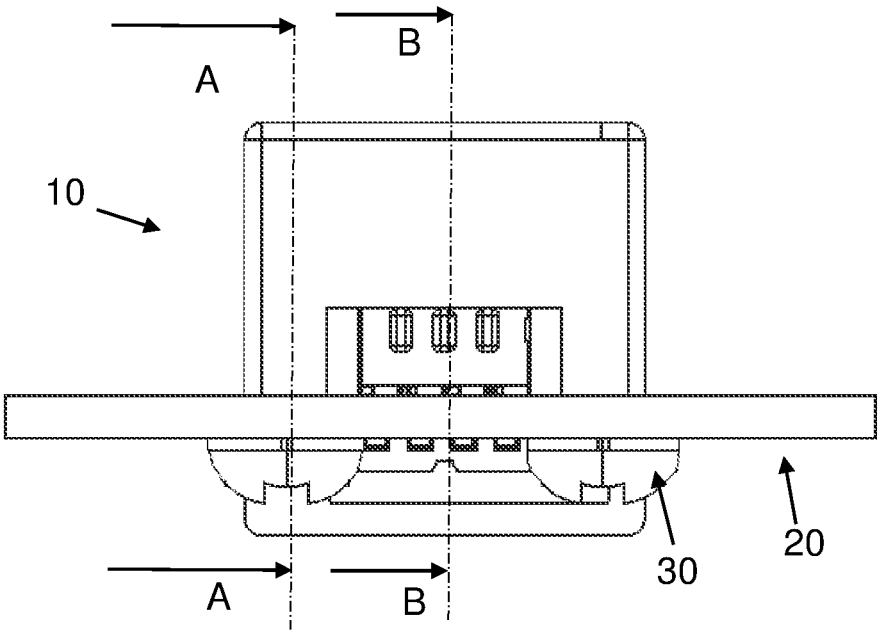
FIG. 6 is a side view of the electrical connector of FIG. 1.
Figure 7:
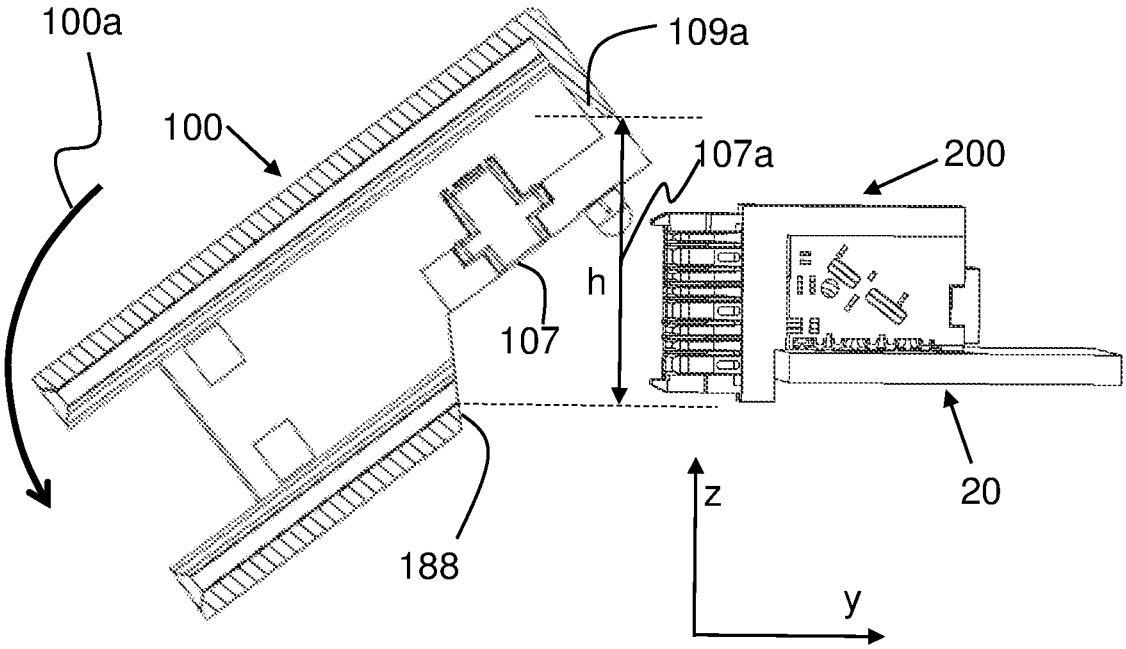
FIG. 7 to FIG. 11 are cross section views of the assembling process of the electrical connector of FIG. 1.
Figure 8:
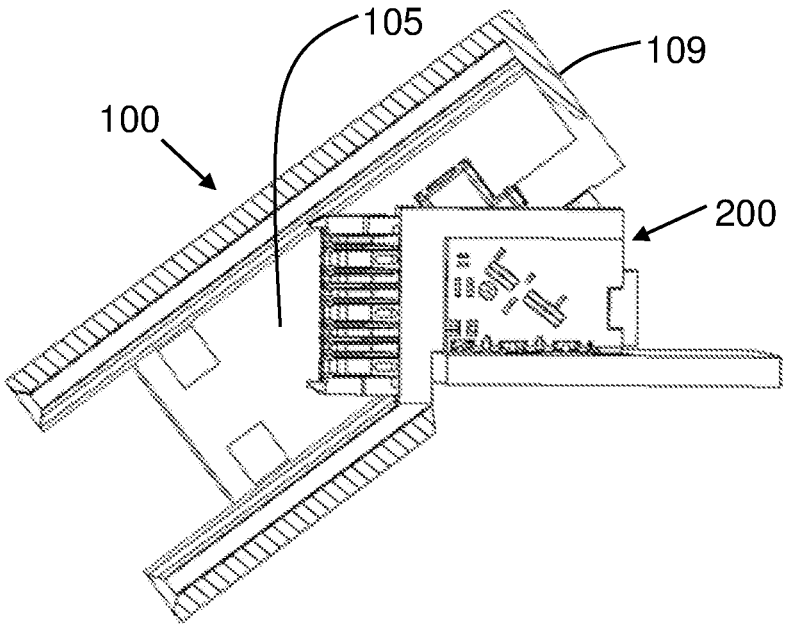
Figure 9:
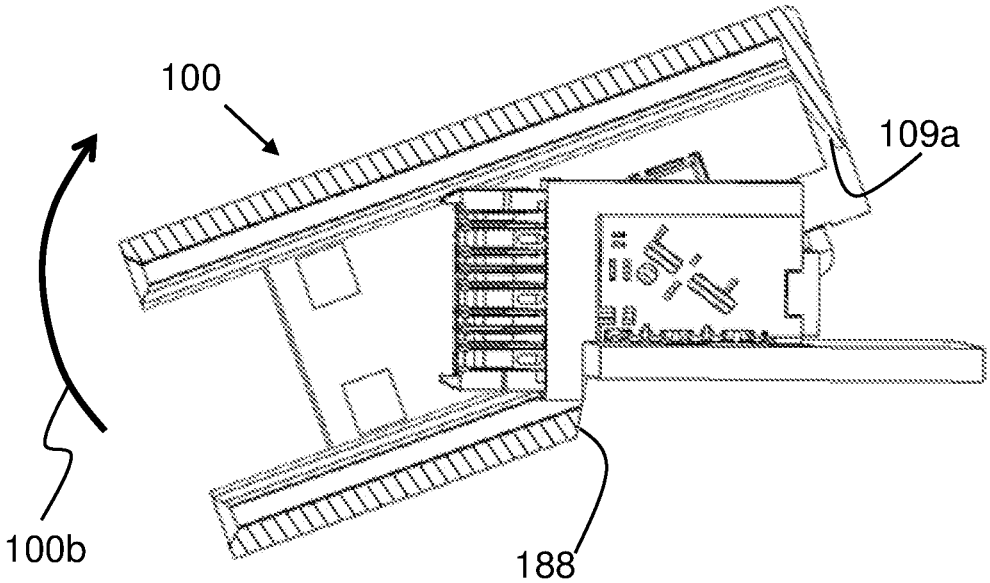
Figure 10:
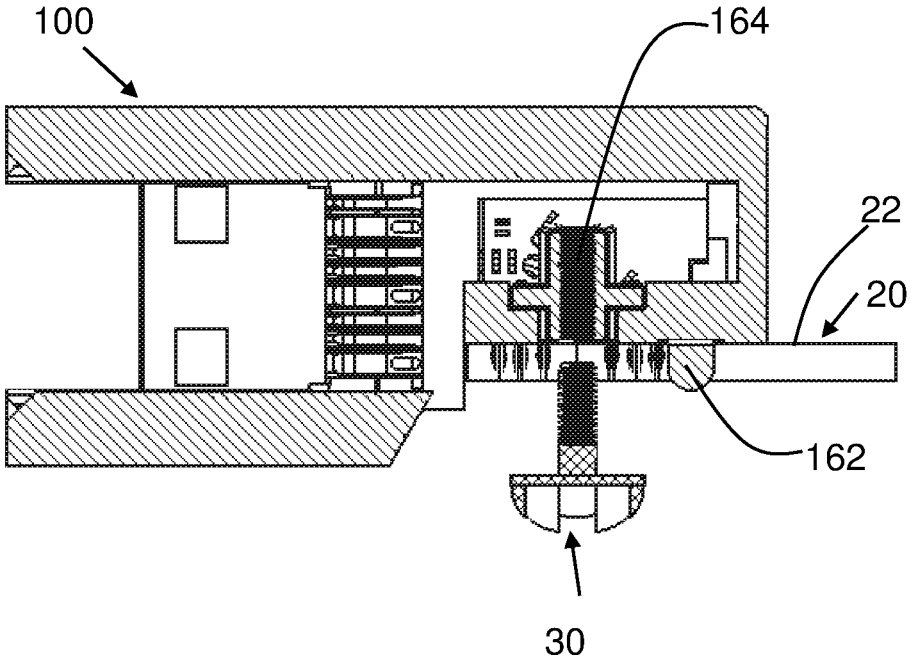
Figure 11:
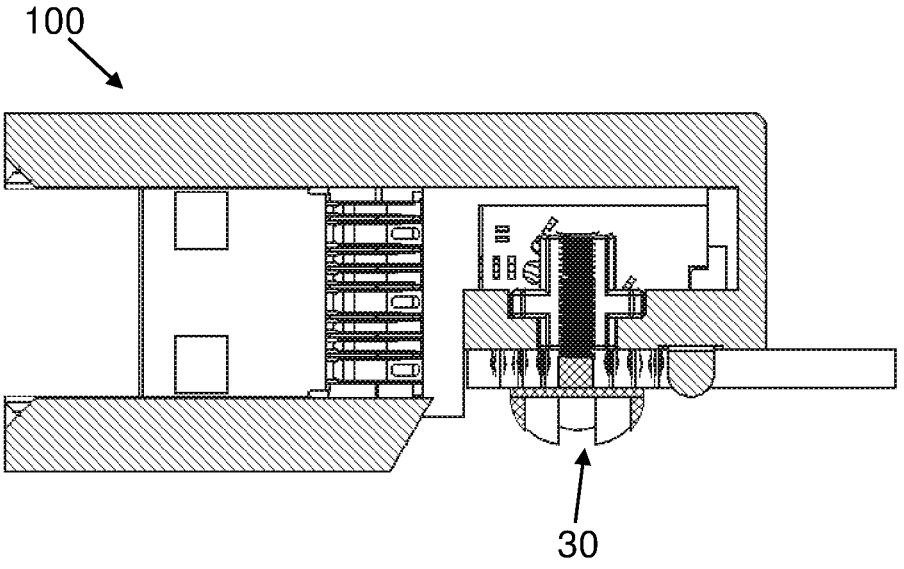

FIG. 6 is a rear view of the electrical connector 10. FIG. 7 to 11 are cross sectional views of the housing 110, terminal module 200 in a process of mounting to a printed circuit board. FIG. 7 to 9 are cross sectional views along line B-B in FIG. 6 and FIGS. 10 and 11 are cross section views along line A-A in FIG. 6.

As shown in FIG. 7, in an assembling process, the housing 100 is rotated counterclockwise in the yz plane along a tilting direction 100*a* such that an effective height 107*a* (i.e. a projected height h of a distance from the back chamfer 109*a* of the back portion 109 to the back edge 188 of the back portion 180 in the z axis direction) of the back entrance 107 is larger than a height of the terminal module 200. Subsequently, as shown in FIG. 8, the housing 100 is moved toward the terminal module 200 such that the terminal module 200 enters the accommodating chamber 105 from the back entrance 107. After the terminal module 200 passes the back portion 109 of the housing 100, and taken the back edge 188 of the back portion 180 as a center as shown in FIG. 9, the housing 100 is rotated clockwise in the yz plane along an opposite direction 100*b*, to fully accommodate the terminal module 200. The back chamfer 109*a* permits passing of the terminal module 200 and accommodating of the terminal module 200 during assembling of the housing 100.

A height of the back portion 109 and a size of the back chamfer 109*a* can be predetermined according to the height and size of the terminal module 200, to enable assembly of the terminal module 200 and the housing 100 to a printed circuit board in the above-illustrated manner.

When the mounting surfaces of the left portion 140 and the right portion 160 abut against a mounting surface 22 of the printed circuit board 20, as seen in FIG. 10, the positioning posts 142 and 162 are inserted into corresponding holes of the printed circuit board 20 to position the housing 100. This makes accurate assembling position and prevents falling of the housing 100 during assembling. The spherical top ends make the positioning posts 142 and 146 easy insertion into the corresponding holes of the printed circuit board 20. Once the positioning posts 142 and 146 are inserted into the holes of the printed circuit board 20, the resilient pieces 142*d* and 146*d* are fastened in the holes to secure the housing 100 to the printed circuit board 20. Mounting screws are then fastened to the mounting holes 144, 146 through the printed circuit board 20, to fix the housing 10 to the printed circuit board 20.

Figure 12:
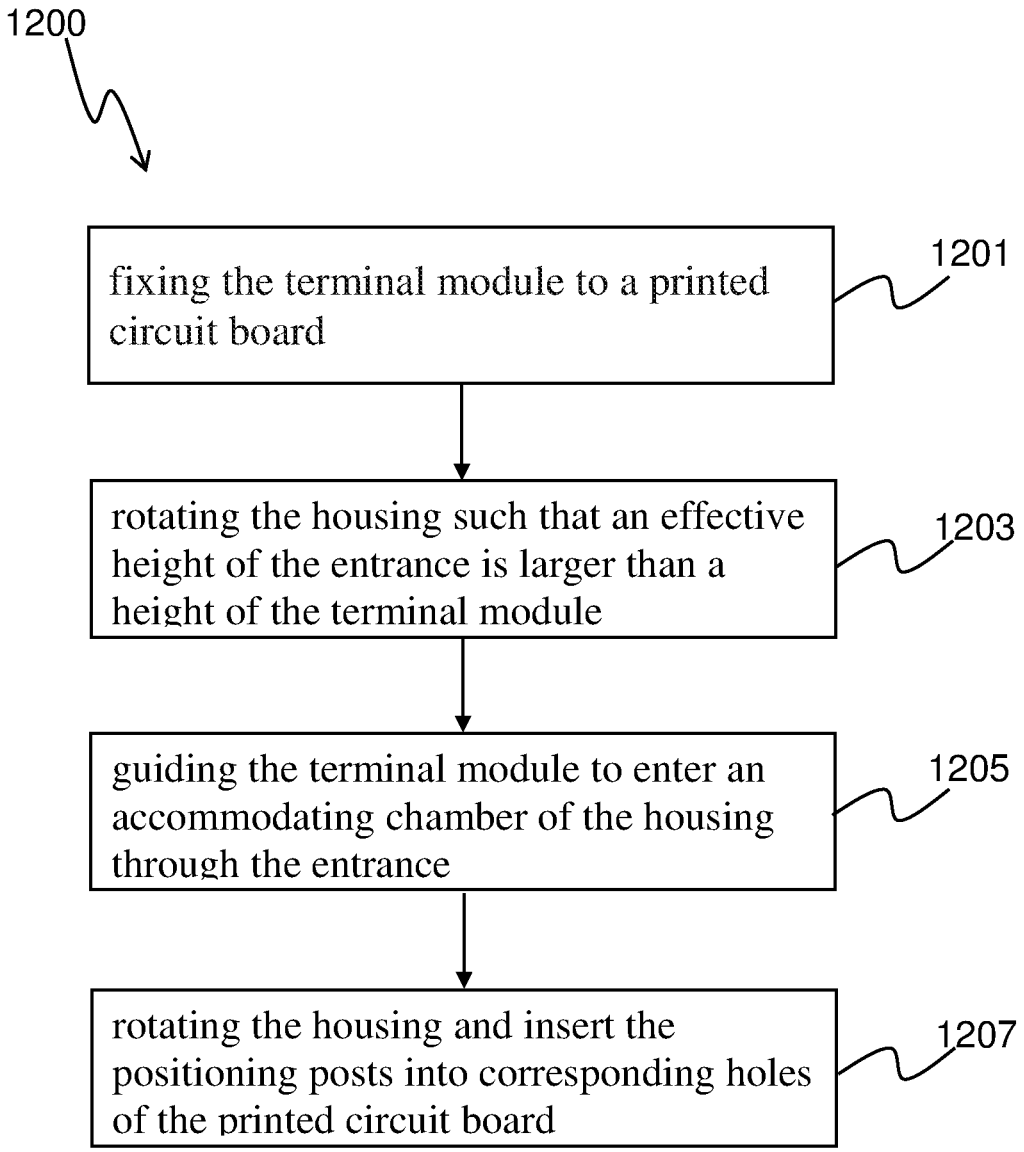
FIG. 12 illustrates a method of assembling an electrical connector in accordance with one embodiment.

FIG. 12 illustrates a method 1200 of assembling an electrical connector in accordance with one embodiment. The electrical connector comprises a housing and a terminal module, the housing has an accommodating chamber and an entrance to the accommodating chamber, and positioning posts. At step 1201, the terminal module is fixed to a printed circuit board. At step 1203, the housing is rotated such that an effective height of the entrance is larger than a height of the terminal module. At step 1205, the terminal module is guided to enter the accommodating chamber of the housing through the entrance. At step 1207, the housing is reversely rotated and with the positioning posts inserted into corresponding holes of the printed circuit board.

While exemplary embodiments have been presented in the foregoing detailed description of the invention, it should be appreciated that a vast number of variations exist.

For example, housing 100 may be formed of any suitable material. In some embodiments, housing 100 may be formed of a conductive material, such as may result from folding a sheet of metal into walls bounding an accommodating portion. As another example, housing 100 may be partially or fully formed of a conductive material by die casting. In embodiments in which housing is fully or partially conductive, the conductive portions may be coupled to ground, either through attachment to printed circuit board 20 or through connections to grounded portions of terminal module 200. In other embodiments, housing 100 may be fully or partially insulating. In those embodiments, housing 100 may be formed by molding a thermoplastic material, for example. In embodiments in which housing 100 is partially insulating, the insulating portions may be positioned to align with signal terminals in terminal module 200.

It should further be appreciated that the exemplary embodiments are only examples, and are not intended to limit the scope, applicability, operation, or configuration of the invention in any way. Rather, the foregoing detailed description will provide those skilled in the art with a convenient road map for implementing an exemplary embodiment of the invention, it being understood that various changes may be made in the function and arrangement of elements and method of operation described in an exemplary embodiment without departing from the scope of the invention as set forth in the appended claims.

The invention claimed is:

1. An electrical connector, comprising:

a housing; and a terminal module having a mating end for receiving a counterpart connector at a front of the terminal module and a back of the terminal module opposite the front of the terminal module, wherein:

the housing has a top portion, a bottom portion, a back portion and two side portions connecting the top portion and the bottom portion, the top portion, the bottom portion, the back portion and the two side portions form an accommodating chamber and the terminal module is accommodated in the accommodating chamber, wherein the back portion of the housing extends downward from the top portion to enclose the back of the terminal module within the accommodating chamber, wherein an entrance to the accommodating chamber is bounded by edges of the side portions, the bottom portion, and the back portion, and wherein a distance across the entrance from the edge of the back portion to the edge of the bottom portion is longer than a height of the terminal module and shorter than a length of the terminal module.

2. The electrical connector according to claim 1, wherein the entrance has a chamfer.

3. The electrical connector according to claim 1, wherein the entrance has two chamfers.

4. The electrical connector according to claim 3, wherein the two chamfers are disposed at opposed positions of the entrance.

5. An electrical connector, comprising:

a housing; and a terminal module having a mating end for receiving a counterpart connector at a front of the terminal module and a back of the terminal module opposite the front of the terminal module, wherein:

the housing has a top portion, a bottom portion, and two side portions connecting the top portion and the bottom portion, the top portion, the bottom portion and the two side portions form an accommodating chamber and the terminal module is accommodated in the accommodating chamber, wherein a back portion of the housing extends downward from the top portion to enclose the back of the terminal module within the accommodating chamber, wherein an entrance to the accommodating chamber is bounded by the two side portions, the bottom portion, and the back portion of the housing, wherein the back portion has a notch at a bottom end thereof, wherein a distance across the entrance from the notch at the bottom of the back portion to an edge of the bottom portion is longer than a height of the terminal module and shorter than a length of the terminal module, and wherein the top portion and the bottom portion are configured to prevent vertical displacement of the housing relative to the terminal module.

6. The electrical connector according to claim 1, wherein the back portion has a notch at a bottom end thereof.

7. The electrical connector according to claim 1, wherein the two side portions comprise a left side portion and a right side portion, and wherein the back portion is connected to a back edge of the left side portion and a back edge of the right side portion.

8. The electrical connector according to claim 2, wherein the housing comprises:

a left mounting surface disposed between the back portion and the chamfer, and a right mounting surface disposed between the back portion and the chamfer, and positioning posts disposed on the left mounting surface and the right mounting surface.

9. The electrical connector according to claim 5, wherein the two side portions comprise a left side portion and a right side portion, and wherein the back portion is connected to a back edge of the left side portion and a back edge of the right side portion.

10. The electrical connector according to claim 5, wherein the back portion has a back chamfer facing the accommodating chamber.

11. The electrical connector according to claim 5, wherein the housing has a left mounting surface disposed between the back portion and a bottom chamfer, and a right mounting surface disposed between the back portion and the bottom chamfer, and wherein positioning posts are disposed on the left mounting surface and the right mounting surface.

12. The electrical connector according to claim 11, wherein the left mounting surface comprises a left mounting hole and the right mounting surface comprises a right mounting hole.

13. The electrical connector according to claim 12, wherein the left mounting hole and a left positioning post of the positioning posts are aligned in a line parallel with a length of the housing.

14. An electrical connector, comprising:

a housing; and a terminal module having a mating end for receiving a counterpart connector at a front of the terminal module and a back of the terminal module opposite the front of the terminal module, wherein the housing has a top portion, a bottom portion, and two side portions connecting the top portion and the bottom portion, the top portion, the bottom portion, and the two side portions form an accommodating chamber and the terminal module is accommodated in the accommodating chamber, wherein a back portion of the housing extends downward from the top portion to enclose the back of the terminal module within the accommodating chamber, wherein the two side portions comprise a left side portion and a right side portion and a back edge of the left side portion, a back edge of the right side portion, and a back edge of the bottom portion form a bottom chamfer, and wherein the two side portions have positioning posts preventing horizontal displacement of the housing relative to the terminal module, and the top portion and the bottom portion prevent vertical displacement of the housing relative to the terminal module.

15. The electrical connector according to claim 14, wherein:

the back portion is connected to a second back edge of the left side portion and a second back edge of the right side portion.

16. The electrical connector according to claim 15, wherein the back portion has a back chamfer facing the accommodating chamber.

17. The electrical connector according to claim 15, further comprising an entrance bounded by the two side portions, the bottom portion, and the back portion.

18. The electrical connector according to claim 17, wherein the entrance is formed such that a length from a bottom edge of the back portion to a back edge of the bottom portion of the entrance is shorter than a length of the terminal module.

19. The electrical connector according to claim 15, wherein the housing has a left mounting surface disposed between the back portion and the bottom chamfer, and a right mounting surface disposed between the back portion and the bottom chamfer, and wherein the positioning posts are disposed on the left mounting surface and the right mounting surface.

* * * * *